US006673445B2

(12) United States Patent
Kitagawa et al.

(10) Patent No.: US 6,673,445 B2
(45) Date of Patent: Jan. 6, 2004

(54) POLYBENZAZOLE FIBERS AND THEIR UTILIZATION

(75) Inventors: Tooru Kitagawa, Ohtsu (JP); Hideki Sugihara, Ohtsu (JP); Yoshimitsu Sakaguchi, Ohtsu (JP); Atsushi Kaji, Ohtsu (JP); Yukihiro Nomura, Ohtsu (JP)

(73) Assignee: Toyo Boseki Kabushiki Kaisha, Osaka (JP)

( * ) Notice: Subject to any disclaimer, the term of this patent is extended or adjusted under 35 U.S.C. 154(b) by 0 days.

(21) Appl. No.: 10/258,138

(22) PCT Filed: Apr. 27, 2001

(86) PCT No.: PCT/JP01/03690

§ 371 (c)(1),
(2), (4) Date: Oct. 21, 2002

(87) PCT Pub. No.: WO01/83862

PCT Pub. Date: Aug. 11, 2001

(65) Prior Publication Data

US 2003/0152769 A1 Aug. 14, 2003

(30) Foreign Application Priority Data

Apr. 28, 2000 (JP) ..... 2000-130892

May 9, 2000 (JP) ..... 2000-136154

(51) Int. Cl.[7] ..... D01F 6/00

(52) U.S. Cl. ..... 428/364; 428/394

(58) Field of Search ..... 528/183; 428/364, 428/394

(56) References Cited

U.S. PATENT DOCUMENTS 5,286,833 A 2/1994 Bubeck et al.
5,993,963 A * 11/1999 Teramoto et al. ..... 428/364
6,040,050 A * 3/2000 Kitagawa et al. ..... 428/394

FOREIGN PATENT DOCUMENTS

EP 0 885 987 12/1998
WO WO 96/10661 4/1996

* cited by examiner

*Primary Examiner*—N. Edwards
(74) *Attorney, Agent, or Firm*—Morrison & Foerster LLP

(57) ABSTRACT

Polybenzazole fibers wherein the mean square roughness of the fiber surface is 20 nm or less, or polybenzazole fibers wherein the X-ray meridian diffraction half-height width factor is 0.3°/GPa or less, and their utilization such as shock-resistant members and heat-resistant felt, etc.

15 Claims, 5 Drawing Sheets

POLYBENZAZOLE FIBERS AND THEIR UTILIZATION

TECHNICAL FIELD

The present invention relates to polybenzazole fibers with a fine surface structure or with a defect-free fiber structure, which are suitable as industrial materials, to a shock-resistant member, heat-resistant felt and the like that utilize the fibers thereof.

BACKGROUND ART

Polybenzazole fibers have a strength and an elastic modulus that are twice or more those of polyparaphenylene terephthalamide fibers, typical super fibers commercially available at present, and are expected to be next-generation super fibers.

To produce fibers from a polyphosphoric acid solution of a polybenzazole polymer has been well known. For example, spinning conditions are disclosed in U.S. Pat. Nos. 5,296,185 and 5,385,702, washing and drying methods are disclosed in International Publication WO94/04726, and further a heat treatment method is disclosed in U.S. Pat. No. 5,296,185.

DISCLOSURE OF THE INVENTION

However, polybenzazole fibers made by the aforementioned conventional methods generally have an equilibrium moisture content of 0.6% or more, even though they are subjected to heat treatment at 350° C. or higher as disclosed in U.S. Pat. No. 5,296,185. This is an obstacle upon applications to the fields of avoiding extreme moisture absorption of fibers, such as an application to a high-performance high-density electronic circuit board for silicon chip mounting.

Nevertheless, polybenzazole fibers are manufactured by the removal of the solvent from a polymer solution, and thus the generation of voids is unavoidable, and the presence of these voids is a factor of increasing water absorbency. On the other hand, although many polybenzazole fibers with a void size of 25 Å or less in the fibers are proposed (for example, JP 6-240653 A, JP 6-245675 A, JP 6-234555 A, etc.), the production of these fibers is not easily accomplished when taking industrial production in terms of cost, etc. into consideration. Furthermore, the voids are very small, and water once penetrated into the sites is difficult to be removed, which becomes a hindrance for the reduction of moisture absorbency.

Accordingly, the production of polybenzazole fibers of extremely low water absorbency is not completed yet so far.

Thus, the present inventors have studied intensively in order to develop a technology for easily manufacturing polybenzazole fibers having extremely low water absorbency as an organic fiber material or having a high thermal conductivity property.

As a means for realizing the ultimate physical properties of fibers, stiff polymers such as a so-called ladder polymer have been considered. However, such stiff polymers have no flexibility. Then, in order to provide flexibility and processability as organic fibers, an important condition is that a fiber is a linear polymer.

S. G. Wierschke et al. have shown that a linear polymer with a highest theoretical elastic modulus is cis-form polyparaphenylene benzobisoxazole, in Material Research Society Symposium Proceedings Vol. 134, p. 313 (1989). This result was also confirmed by Tashiro et al. (Macromolecules vol. 24, 706 (1991)). Among polybenzazoles, cis-form polyparaphenylene benzobisoxazole has a crystalline modulus of 475 GPa (P. Galen et al., Material Research Society Symposium Proceedings Vol. 134, p. 329 (1989)) and was thought to have an ultimate primary structure. Therefore, it is theoretically concluded that polyparaphenylene benzobisoxazoles should be selected as polymers for material in order to obtain the ultimate elastic modulus.

Fiber production from the polymer is performed by the methods as disclosed in U.S. Pat. Nos. 5,296,185 and 5,385,702, heat treatment thereof is carried out by the method as proposed in U.S. Pat. No. 5,296,185. Yarn obtained by such methods has an equilibrium moisture content of 0.6% or more. In addition, yarn obtained by such methods has a sound wave propagation velocity of at most about 1.3×10 6 cm/sec. Thus, the present inventors have recognized the necessity for studies on the improvement of these methods, and studied and found out that the desired physical properties are readily industrially attainable by the method as described hereinafter, even if a void size is 25.5 Å or more diameter in fibers.

DETAILED DESCRIPTION OF THE INVENTION

Figure 1:
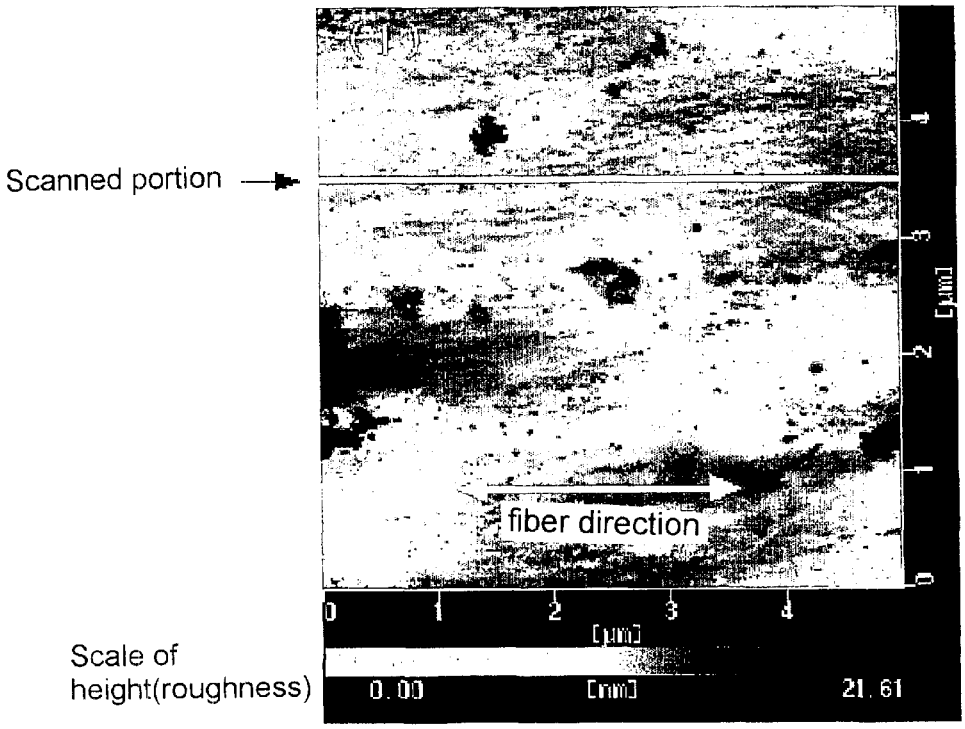
FIG. 1 (1) shows a photograph of the fiber of the present invention in the range of 5 $\mu m^2$ as observed by an atomic force microscope (AFM) and FIG. 1 (2) expresses the roughness (height) in the one dimensional range (direction parallel to the fiber axis) indicated by the white line in FIG. 1 (1) as a function of the distance.
Figure 1:
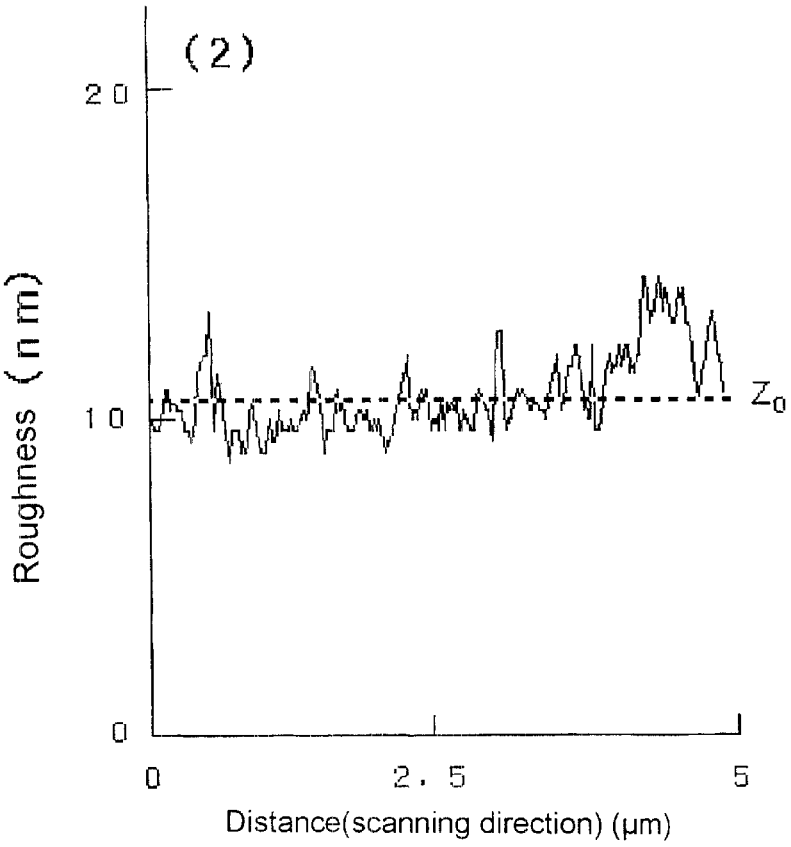

A fiber surface structure requires compactness in order to further reduce the equilibrium moisture content of polybenzazoles.

That is, the first invention is a polybenzazole fiber characterized by the mean square roughness of the fiber surface being 20 nm or less, and further preferably a polybenzazole fiber characterized by the crystalline orientation angle of the fiber surface being 1.3 degrees or less, a fiber characterized by the equilibrium moisture content being 0.6% or less, or a polybenzazole fiber characterized in that the number of cycles to the rupture in the abrasion test is 5200 or more.

A dope comprising polyparaphenylene benzobisoxazole (PBO) and polyphosphoric acid is spun from a spinneret. Thereafter, a fiber is produced by passing through the steps of coagulation, neutralization, water washing, drying, and heat treatment under stress. To reduce the equilibrium moisture content low, there is a method of making a fiber having closely packed and highly oriented the crystal structure in the surface portion of the fiber. In the present invention, to that end, the crystal structure in the surface of a polybenzazole fiber was successfully made dense, and a polybenzazole fiber, the water absorption of which is suppressed low, was obtained industrially.

The crystal structure in the surface of such a fiber is characterized by the mean square roughness of the fiber surface being 20 nm or less, and further preferably the fiber is characterized by the crystal orientation angle of the fiber surface as being 1.3 degrees or less, or characterized by the equilibrium moisture content as being 0.6% or less, or is a polybenzazole fiber characterized in that the number of cycles to the rupture in the abrasion test is 5200 or more. Therefore, the present invention overcomes the technical difficulties thus far in the technical background, provides a polyparaphenylene benzobisoxazole fiber, the equilibrium moisture content of which is made closer to zero by realizing a particular crystallite orientation, and enables the industrial production thereof.

In addition, there are defect structures in a fiber such as disorders of voids and misorientation of crystallites and the presence of molecular ends and amorphous portions as is shown by Ohta in Polymer Engineering and Science, 23, p. 697 (1983). The presence of these defects causes the prevention of thermal vibrations and sound wave propagation, thus reducing the thermal conductivity. However, the generation of voids in a polybenzazole fiber is unavoidable inasmuch as the fiber is manufactured by removing the solvent from the polymer solution. For this reason, while many methods of preventing decreases in physical property of the fibers by reducing the void sizes to 25 Å or less in the fibers are proposed (for example, JP 6-240653 A, JP 6-245675 A, JP 6-234555 A, etc.) are proposed, production of these fibers is not easily accomplished when taking industrial production in terms of cost, etc. into consideration.

Nonetheless, it is essential to reduce defect structures present in a fiber structure in order to improve the thermal conductivity of a polybenzazole fiber.

As discussed above, a dope comprising polyparaphenylene benzobisoxazole (PBO) and polyphosphoric acid is spun from a spinneret nozzle. Thereafter, a fiber is produced by passing through the steps of coagulation, neutralization, water washing, drying, and heat treatment under stress. In addition, in order to enhance the thermal conductivity, it is required that defect structures such as an amorphous phase, which prevent the thermal vibration propagation of a fiber, be removed as much as possible. This time, to this end, the inventors have successfully changed the inner structure of a polybenzazole fiber into a defect-free structure and also have industrially obtained a polybenzazole fiber exhibiting a high velocity of sound propagation.

That is to say, the second invention is a polybenzazole fiber characterized in that the X-ray meridional diffraction half-height width factor is 0.3°/GPa or less. More preferably, the present invention relates to an invention concerning a polybenzazole fiber wherein the amount of reduction of the elastic modulus due to a molecular orientation change is 30 GPa or less, a polybenzazole fiber wherein the $T_{1H}$ (proton) relaxation time is 5.0 seconds or more, a polybenzazole fiber wherein the $T_{1C}$, (carbon 13) relaxation time is 2000 seconds or more, a polybenzazole fiber wherein the thermal conductivity is 0.23 W/cm K or more, a polybenzazole fiber wherein the anisotropic factor of the expansion coefficient is 4.5 per million or less, or a polybenzazole fiber wherein the fiber elastic modulus is 300 GPa or more.

These features enable the provision of a polyparaphenylene benzobisoxazole fiber with remarkably height thermal conductivity and its industrial production.

For the manifestation of the aforementioned structural characteristics, the points of the present invention can be realized by the following methods. In other words, a dope of a polymer comprising polyparaphenylene benzobisoxazoles is extruded into a non-coagulation gas from a spinneret coagulation to give a spun yarn. This yarn is introduced into a solidifying bath and the phosphoric acid contained in the yarn was extracted. The yarn then subjected to neutralization, water washing, drying and heat treatment. It has been found that a polybenzazole with dense fiber surface is obtainable by heat treatment at 500° C. or higher under a constant stress.

The present invention will be further described in detail hereinafter.

A polybenzazole fiber in the present invention refers to a random, sequential or block copolymer with a polybenzazole, the copolymer containing a PBO homopolymer and substantially 85% or more of a PBO component. Here, a polybenzazole (PBZ) polymer is described, for example, in U.S. Pat. No. 4,703,103 (Oct. 27, 1987), "Liquid Crystalline Polymer Compositions, Process and Products"; U.S. Pat. No. 4,533,692 (Aug. 6, 1985), "Liquid Crystalline Polymer Compositions, Process and Products"; U.S. Pat. No. 4,533,724 (Aug. 6, 1985), "Liquid Crystalline Poly(2, 6-Benzothiazole) Compositions, Process and Products"; U.S. Pat. No. 4,533,693 (Aug. 6, 1985), "Liquid Crystalline Polymer Compositions, Process and Products" by Wolf et al.; U.S. Pat. No. 4,539,567 (Nov. 16, 1982), "Thermooxidative-ly Stable Articulated p-Benzobisoxazole and p-Benzobisoxazole Polymers" by Evers; U.S. Pat. No. 4,578,432 (Mar. 25, 1986), "Method for making Heterocyclic Block Copolymer" by Tsai; and the like.

Structural units contained in PBZ polymers are preferably selected from lyotropic liquid crystalline polymers. Monomer units preferably comprise monomer units indicated by the structural formulas (a) to (h) and more preferably comprise essentially monomer units selected from the structural formulas (a) to (d).

(a)

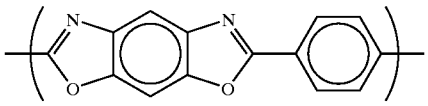

(b)

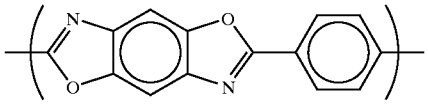

(c)

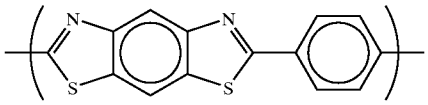

(d)

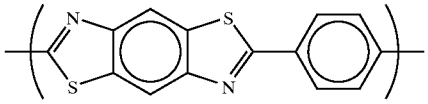

-continued (e)

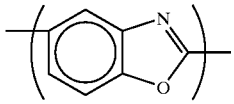

(f)

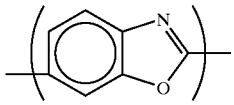

(g)

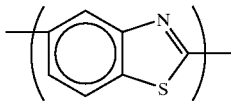

(h)

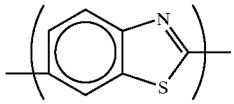

Suitable solvents for substantially forming a dope of a polymer comprising PBOs include cresol and non-oxidizing acids capable of dissolving the polymer. Examples of suitable acid solvents include polyphosphoric acid, methanesulfonic acid, highly concentrated sulfuric acid, and mixtures of these. More suitable solvents include polyphosphoric acid and methanesulfonic acid. In addition, the most suitable solvent is polyphosphoric acid.

The concentration of a polymer in the solvent is preferably at least about 7% by weight, more preferably at least 10% by weight, and most preferably 14% by weight. The maximum concentration has a limitation, for example, by actual handling properties such as the solubility of a polymer and a dope viscosity. Because of these limitation factors, the polymer concentration does not exceed 20% by weight.

Suitable polymers, copolymers or dopes are synthesized by well-known methods. For example, they are synthesized by methods disclosed in U.S. Pat. No. 4,533,693 (Aug. 6, 1985) by Wolfe et al.; U.S. Pat. No. 4,772,678 (Sep. 20, 1988) by Sybert et al.; and U.S. Pat. No. 4,847,350 (Jul. 11, 1989) by Harris. A polymer substantially comprising PBOs can be highly polymerized at a high reaction rate at a relatively high temperature under high shear in a dehydrating acid solvent according to U.S. Pat. No. 5,089,591 (Feb. 18, 1992) by Gregory et al.

In this way, a polymerized dope is supplied to the spinning part and is spun from a spinneret normally at a temperature of 100° C. or higher. An arrangement of holes in the spinneret is usually made circumferentially and in a lattice form, but other arrangements are also acceptable. The number of the holes in the spinneret is not particularly limited; however, with the arrangement of the spinning holes on the spinneret face, the hole density needs to be maintained in order for the fusion among spun yarn not to occur.

Spun yarn requires a draw zone length of a sufficient length as disclosed in U.S. Pat. No. 5,296,185 and is also desirably cooled uniformly via rectified cooling wind of a relatively high temperature (solidification temperature or higher of a dope and the spinning temperature or lower) in order to obtain an adequate stretch draw ratio (SDR). The length (L) of the draw zone requires a length in which solidification is completed in a non-coagulable gas and is roughly determined by the amount of discharge by a single pore (Q). The taking-out stress of the draw zone is desirably 2 g/d or more in terms of polymer (assume that only the polymer undergoes the stress) in order to obtain good fiber physical properties.

The yarn drawn in the draw zone is then introduced into an extraction (coagulation) bath. Because of a high spinning tension, disorders of the extracting bath does not need to be taken into account, and any forms of extracting bathes are acceptable. Examples for use include a funnel type, a water bath type, an aspirator type and a waterfall type. Desirable extracting liquids include a phosphoric acid aqueous solution and water. The phosphoric acid contained in the yarn in the extracting bath is extracted in an amount of 99.0% or more, more preferably in an amount of 99.5% or more. Liquids used as extracting media of the present invention are not particularly limited, but preferably include water, methanol, ethanol, acetone, and ethylene glycol, which are substantially incompatible with a polybenzazole. In addition, the extraction (coagulation) bath may be separated into an arrangement of stages, the concentration of a phosphoric acid aqueous solution may be reduced one by one, and the yarn may finally be washed with water. Furthermore, desirably, the fiber bundles are neutralized using a sodium hydroxide aqueous solution, or the like, and then are washed with water.

A method of making dense fiber surface structure, which is particularly important in the present invention, will be described. To prevent humidity absorption, it becomes an important factor to realize the high crystallite orientation of the fiber surface. Therefore, it is important to change the structures in the inner and outer layers of the fiber by reducing the solidifying speed of the fiber dope in the extracting step. Effective methods of decreasing the solidifying speed involve increasing the concentration of a phosphoric acid aqueous solution in the solidifying solution, lowering the bath temperature, and selecting a non-aqueous coagulant agent. An optimal concentration of the phosphoric acid aqueous solution is 50% or more and less than 80%, desirably 55% or more and below 70%, and most desirably 60% or more and below 65%. The higher the concentration, the larger the effect, but when the concentration is higher than required, the strength of the fiber is reduced, which is not preferable. The coagulating temperature of the bath may be any temperature if it is about 5° C. or lower; however, if the temperature is reduced to too low, which produces dew around the bath, and so it is not preferable for the operation of manufacturing machinery. The temperature is preferably within the temperature range of 4° C. to −30° C., more preferably within the temperature range of 0°C. to −15° C. When a non-aqueous coagulating agent is selected, preferable solvents are organic solvents compatible with water that include alcohols such as ethanol and methanol, ketones such as acetone, and glycols such as ethylene glycol. Of course, a plurality of the aforementioned non-aqueous coagulating agents and water may be admixed for utilization.

Thereafter, the fiber is dried and passed through a heat treatment process. The drying temperature is taken as a temperature that does not reduce the fiber strength, more specifically from 150° C. to 400° C. inclusive, preferably from 200° C. to 300° C. inclusive, and more preferably from 220° C. to 270° C. inclusive. The heat treatment temperature is from 400° C. to 700° C. inclusive, preferably from 500° C. to 680° C. inclusive, and more preferably from 550° C. to 630° C. inclusive.

For a fiber relating to the second invention; the mean square roughness of the fiber surface is 20 nm or less, preferably 16 nm or less, and more preferably 10 nm or less; the crystallite orientation angle of the fiber surface is 1.3 degrees or less, preferably 1.1 degrees or less, and more preferably 0.9 degree or less; the equilibrium moisture content is 0.6% or less, preferably 0.55% or less, and more preferably 0.5% or less; the number of cycles to breakage in the abrasion test is 5200 or more, preferably 5600 or more, and more preferably 6000 or more; a void size is 25.5 Å or more, preferably 30 Å or more and less than 150 Å, and more preferably 35 Å or more and less than 90 Å. In addition, indexing of diffraction points used in the present invention is in accordance with the crystal model proposed by Fratini et al. (Material Research Society Symposium Proceedings Vol. 134, p. 431 (1989)).

The mean square roughness Rms of the fiber surface was evaluated by means of the atomic force microscope (AFM). As the AFM used was SPI3800N-SPA300 from Seiko Instruments (SII) Corp. As the probe used was a rectangular Si boom (Si-DF3 from SII Corp.) with a spring constant of 2 N/m, a length of 450 $\mu$m, a width of 60 $\mu$m and a thickness of 4 $\mu$m. A 100 $\mu$m scanner was used as a scanner and the DFM mode was selected as an observing mode. The measurement was carried out at a scanning speed of 0.5 Hz, in the scanning direction parallel to the fiber axis, in an atmosphere, at 20° C., and at a relative humidity of 65%. Fibers used for measurement were cleaned using a mixture solution of ethanol and n-hexane and dried and then used. The observing field range was a square with a side of 5 $\mu$m. After observation, two-dimensional treatment was performed by means of three-dimensional slope correction via an attached software. The presence of curvature of a fiber takes account of the distortion produced when the image was made two-dimensional, and thus calculation was performed after the mean square roughness Rms of a square with a side of 3 $\mu$m only of the central portion was corrected using the attached software. A measurement example is shown in FIG. 1. Observations were randomly made at ten sites or more, each Rms was evaluated, and the mean value was calculated. Moreover, the Rms can be expressed using Equation 1:

$$Rms=[(1/N)\ \Sigma(Z_i-Z_o)^2]^{0.5} \qquad \text{Equation 1}$$

wherein $Z_i$ is a height at each measurement point, $Z_o$ is a mean height throughout the entire measurement sites, and N is the number of measurement points.

FIG. 1 (1) shows a measurement example in the range of 5 $\mu m^2$ and FIG. 1 (2) expresses the roughness (height) in the one dimensional range (direction parallel to the fiber axis) indicated by the white line in FIG. 1 (1) as a function of the distance.

Figure 2:
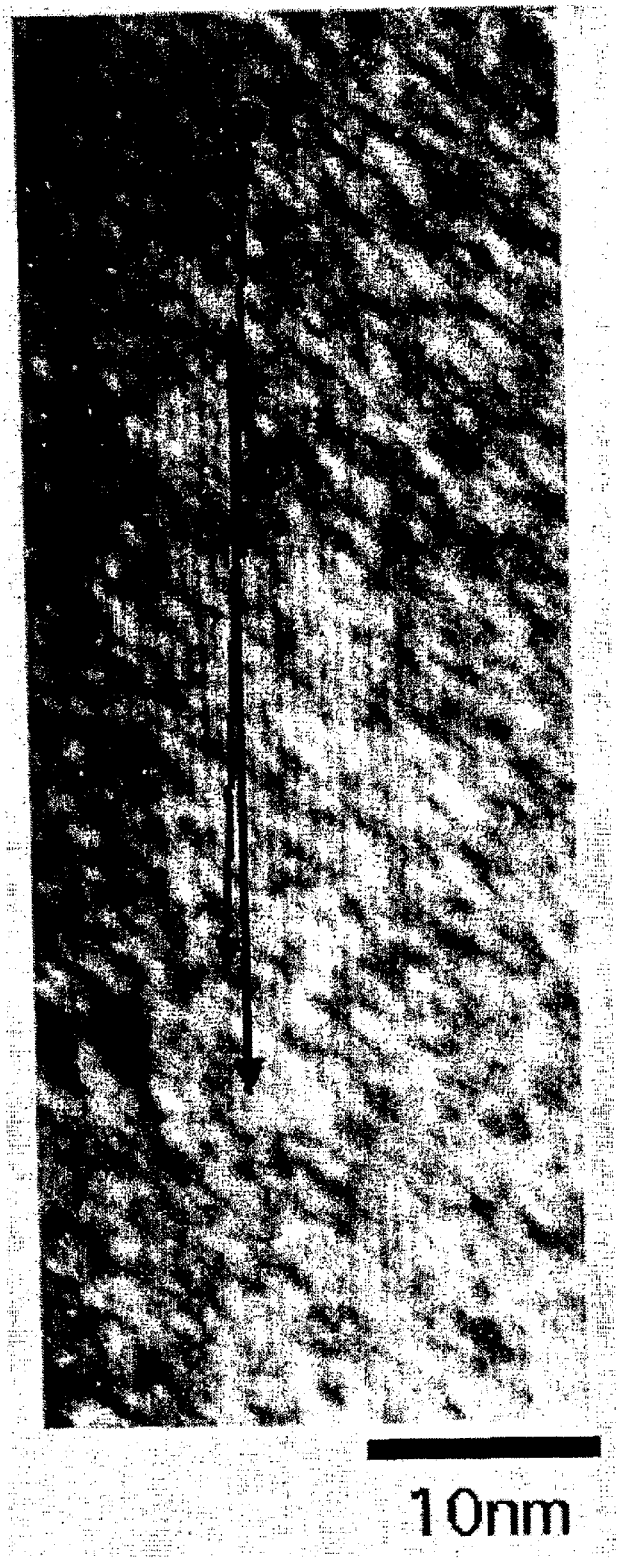
FIG. 2 shows an evaluation example of a lattice image and a crystallite orientation angle when observing the fiber surface of the present invention by means of an electron microscope (e.g. Phillips TEM-430).

A thin strip peeled from the fiber surface is analyzed and evaluated for the crystallite orientation angle of the fiber surface by the observation with high-resolution electronic microscopy (for example, Phillips TEM-430, JEOL JEM-2010). First, a collodion solution diluted with isoamyl acetate is thinly spread on a glass plate and several pieces of fiber single yarn are placed thereon. After the solvent of the collodion solution is evaporated and the solution is solidified, the fiber is peeled out of the glass plate. At this time, on the mark after peeling (on the film of collodion) attached thin strips of the fiber surface body peeled from the fiber can be observed using a stereoscopic microscope. This portion is cut out with a knife or the like in a size of an about 3 mm square along with the film of the collodion and the material thus obtained is put on a microgrid for electronic microscope observation available from Nisshin EM Corp. or on a holey carbon film available from Agar Scientific Corp., with the face, on which the surface thin strip of the polybenzazole fiber is stuck, placed thereon. The material is transferred into a Petri dish with a lid and is allowed to stand under the coexistence with an isoamyl acetate vapor for several hours to thereby stick sufficiently the thin fiber strip to the microgrid. Thereafter, isoamyl acetate was further added so that the microgrid is immersed therein, and then the material is allowed to stand over night. After the collodion film is flowed off, the material is made dried. An electron microscope was used at a magnification of 200,000 times or more at a high-resolution observation with correction for astigmatism. In order to suppress the damage of a sample of a thin fiber strip due to electron beam minimally, the exposure time required for one-field observation is made within 5 seconds, and the total irradiation time also including the correction for astigmatism was restricted within 35% of the life of the fiber (duration which an electronic diffraction pattern having a sufficient resolution can be observed) when the fiber is illuminated with electron beam. For the record of a lattice image with high-resolution electron microscopy, a Kodak SO-163 negative film is developed using a Kodak D-19 developing solution without dilution, or an imaging plate system (e.g. JEOL Pixsys TEM) is utilized. A lattice image taken is printed on a photographic printing paper. There is observed a state in which lattice fringes of the (200) diffraction lies almost parallel to the fiber axis. The angle $\Phi$ formed by two lattice axes of the (200) diffraction of two neighboring crystallites is defined as the crystallite orientation angle. FIG. 2 shows an evaluation example of an observed lattice image and a crystallite orientation angle. A hundred or more of crystallite pairs are observed and the values are averaged to evaluate the crystallite orientation angle.

Figure 3:
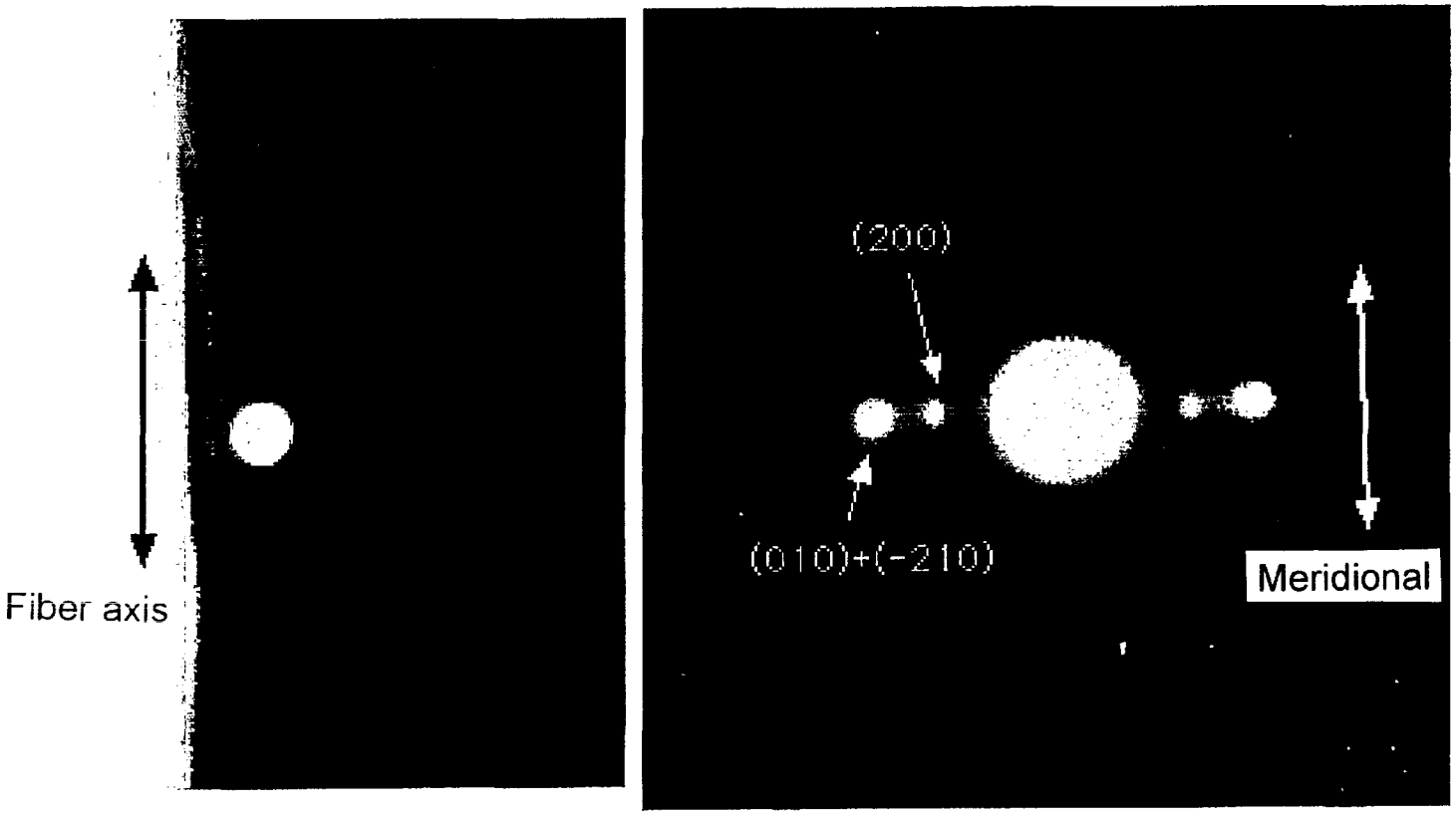
In FIG. 3, the left-side drawing illustrates a bright-field image of an ultra-thin section of a fiber concerning the present invention, the white circle in the drawing shows the region (diameter 0.3 $\mu m$) in which a selected-area electron diffraction pattern is taken, and the right-side drawing shows the selected-area electron diffraction pattern.

The crystallite orientation ratio of the fiber center to the surface is evaluated by measuring a selected-area electron diffraction pattern of an ultra-thin section made by thinly cutting a fiber. A material made by embedding a single fiber with a Spurr epoxy resin mixing a curing agent is allowed to stand in an oven at 70° C. over night for solidification and fixation. Then, this resin block is mounted on an ultramicrotome available from Leihelt Corp. and polish is performed until the embedded fiber appears near the block surface using a glass knife. Thereafter, an ultra-thin section is prepared with a diamond knife available from Diatome Corp., and then is recovered on a copper grid of 300 mesh to thinly conduct carbon vaporization. The ultra-thin sections are placed on an electronic microscope to find a section having both the center and the surface parts of the fiber. Selected-area electron diffraction patterns are taken for both the surface and the center parts. FIG. 3 shows a bright-field image of the ultra-thin section and a portion (diameter 0.3 $\mu$m) in which a selected-area electron diffraction pattern is taken, as well as a measurement example of a selected-area electron diffraction pattern measured. The record of the image is made using a microscope film (for example, Agfa Scientia EM 23D56, or Kodak SO-163 negative film) or an imaging plate system. In accordance with the method by R. J. Young et al. (J. Mat. Sci., 24, p5431 (1990)), the half-height width 2θ of the peak profile is calculated from the diffraction intensity profile distributed in the meridional direction of the (010) and (−210) diffractions, and then the crystallite orientation ratio of the fiber center to the fiber surface is evaluated by dividing the half-height width 2θ of the fiber center by the half-height width 2θ of the fiber surface using Equation 2. In addition, in case the numerical value of the diffraction intensity profile is obtained from the microscope film, an optical negative film density reading apparatus (for example, Joyce-Loebl Chromoscan 3) is utilized.

In FIG. 3, the left-side drawing illustrates a bright-field image of an ultra-thin section, the white circle in the drawing shows the region (diameter 0.3 $\mu$m) in which a selected-area diffraction pattern is taken, and the right-side drawing shows a selected-area electron diffraction pattern.

Crystal orientation ratio=2θ (fiber center)/2θ (fiber surface) Equation 2

The water content of a fiber is determined by weighing after the fiber is allowed to stand at 20° C. at relative humidity of 65% until the weight change is not observed. In other words, after the weight of a fiber is measured using a chemical balance, the fiber is allowed to stand for 30 minutes in an electric oven maintained at 230° C. to remove the moisture in the fiber and then the weight is measured again. The equilibrium moisture content is evaluated by means of Equation 3.

Equilibrium moisture content=100×(fiber weight when reaching equilibrium−fiber weight after drying)/fiber weight after drying [%]

Abrasion resistance was evaluated according to JIS L1095, 7.10.2, that is, the number of cycles to rupture was counted for evaluation. At this time, the fiber was subjected to a tension of 1.0 g/d.

Method for Measuring Small Angle X-ray Scattering

Void sizes were evaluated by the method below using small angle X-ray scattering. X rays supplied for measurements were produced by means of Rotor Flex RU-300 available from Rigaku International Corporation. A copper anode was used as the target and the operation was carried out using a fine focus with a power of 30 kV×30 mA. A point-collimated camera available from Rigaku Co., Ltd. was utilized as the optical system. The X rays were made monochromatic with a nickel filter. As a detector was used an imaging plate (FDL UR-V) available from Fuji Photo Film Co., Ltd. The distance between the sample and the detector was set at an appropriate length between 200 mm and 350 mm. In order to suppress an background scattering due to air, etc., helium gas was filled in between the sample and the detector. The time of exposure was from 2 hours to 24 hours. Scattering intensity signals recorded on the imaging plate were read by means of a digital microluminegraphy (FDL5000) available from Fuji Photo Film Co., Ltd. Data obtained were corrected for background scattering and then a Guinier plot against the scattering intensity I in the equatorial direction (plot the natural logarithm ln(I) of the scattering intensity after background correction against $k^2$ the square of the scattering vector) was constructed. The scattering vector $k=(4\pi/\lambda)\sin\theta$, $\lambda$ is a X-ray wavelength of 1.5418 Å, and θ is a half of the scattering angle 2θ.

Now, a defect-free polybenzazole fiber of a fiber structure in the second invention will be discussed.

It has been found out as a result of an energetical study that further heat treatment under tension after the material carefully formed into a fiber structure with the coagulation speed decreased is dried, is particularly important for the limitless reduction of defects (being made defect-free) in the fiber structure. More specifically, the control of the coagulating temperature is important, and the bath temperature is maintained from −20° C. to 0°C., desirably from −15° C. to −5° C., and more desirably from −12° C. to −8° C. A water-based coagulating agent could be used, but an organic solvent-compatible with water rather led to a good result. In particular, lower alcohols such as methanol and compounds having an OH group with a molecular weight of 400 or less such as ethylene glycol were specially effective. Rendering the bath temperature to be less than −20° C. tends to dramatically deteriorate the yarn physical properties, and so it is not preferable.

The drying temperature is set at a temperature at which the strength of a fiber is not made reduced, more specifically from 150° C. to 400° C. inclusive, preferably from 200° C. to 300° C. inclusive, and more preferably from 220° C. to 270° C. inclusive. With the conditions of heat treatment, the temperature is 500C. or more and less than 700° C., preferably 550° C. or more and less than 650° C., and more preferably 580° C. or more and less than 630° C., and the tension applied at this time is 4.0 g/d or more and less than 12 g/d, preferably 5.0 g/d or more and less than 11 g/d, and more preferably 5.5 g/d or more and less than 10.5 g/d. The water content of a fiber to be applied to heat treatment is controlled to be from 1% to 3% inclusive, preferably from 1.7% to 2.7% inclusive.

In a fiber according to the present invention, the X-ray meridional diffraction half-height width factor is 0.3°/GPa or less, preferably 0.25°/GPa or less, more preferably 0.2°/GPa or less, and most preferably 0.15°/GPa or less. More preferably, the amount of reduction of the elastic modulus $E_r$ due to a molecular misorientation change is 30 GPa or less, preferably 25 GPa or less, and more preferably 20 GPa or less; the $T_{1H}$ relaxation time of proton is 5.0 seconds or more, preferably 6.5 seconds or more, and more preferably 8 seconds or more; the $T_{1C}$ relaxation time of carbon 13 is 2,000 seconds or more, preferably 2,300 seconds or more, and more preferably 2,700 seconds or more; the thermal conductivity is 0.23 W/cm K or more, preferably 0.3 W/cm K or more, and more preferably 0.36 W/cm K or more; the anisotropic factor of the expansion coefficient is −4.5/1,000,000 or less, preferably −6/1,000,000 or less, and more preferably −8/1,000,000 or less; the elastic modulus of the fiber is 300 GPa or more, preferably 340 GPa or more, and more preferably 380 GPa or more; the void size is 25.5 Å or more, preferably from 30 Å to 150 Å inclusive, and more preferably from 35 Å to 90 Å.

Analysis methods for proving the realization of a defect-free structure will be discussed hereinafter. A polybenzazole fiber exhibits very stiff structure as an organic fiber, and so it is not easy to prepare an ultra-thin section for the observation of the electronic microscope. The crystal has a structural disorder called as axial shift and does not form a firm, complete crystal. Accordingly, static analyses even by wide angle X-ray diffraction or small angle X-ray scattering did not give sufficient information. Thus, structural analysis was performed by measurement via X-ray diffraction while giving the fiber a stimulus (stress) or evaluation of the relaxation time by means of solid-state NMR spectroscopy.

Method for Measuring X-ray Half-height Width Factor

Figure 4:
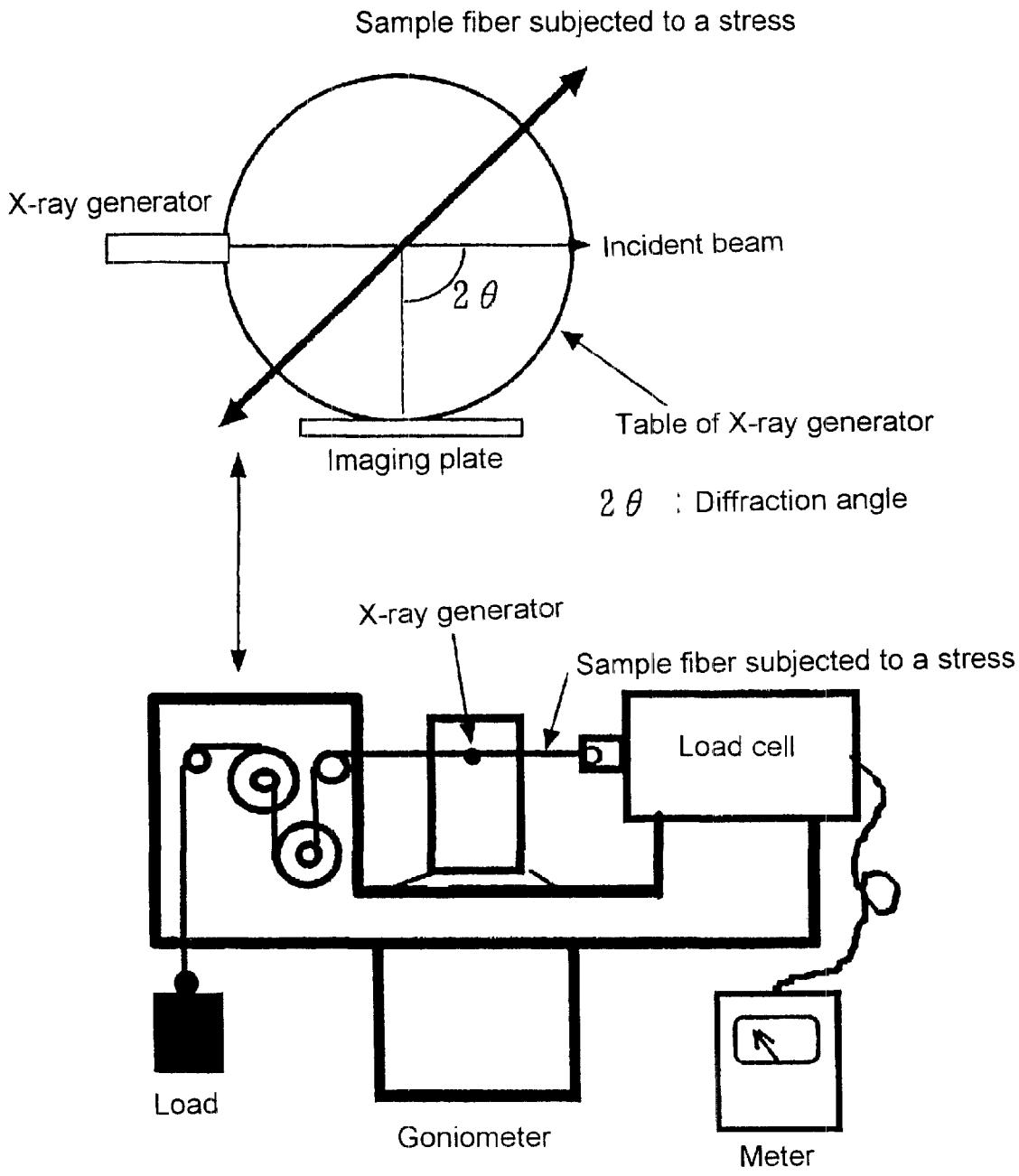
FIG. 4 is a schematic diagram of an apparatus for measuring an X-ray half-value width factor.

An apparatus that applies tension to a fiber as shown in FIG. 4 was constructed and was mounted on a goniometer available from Rigaku (Ru-200 X-ray generator, RAD-rA system) to determine the stress dependency of line width of the (00 10) diffraction. The generator was operated using a power of 40 kV×100 mÅ. to generate the CuK α line from the copper rotating anode.

Figure 5:
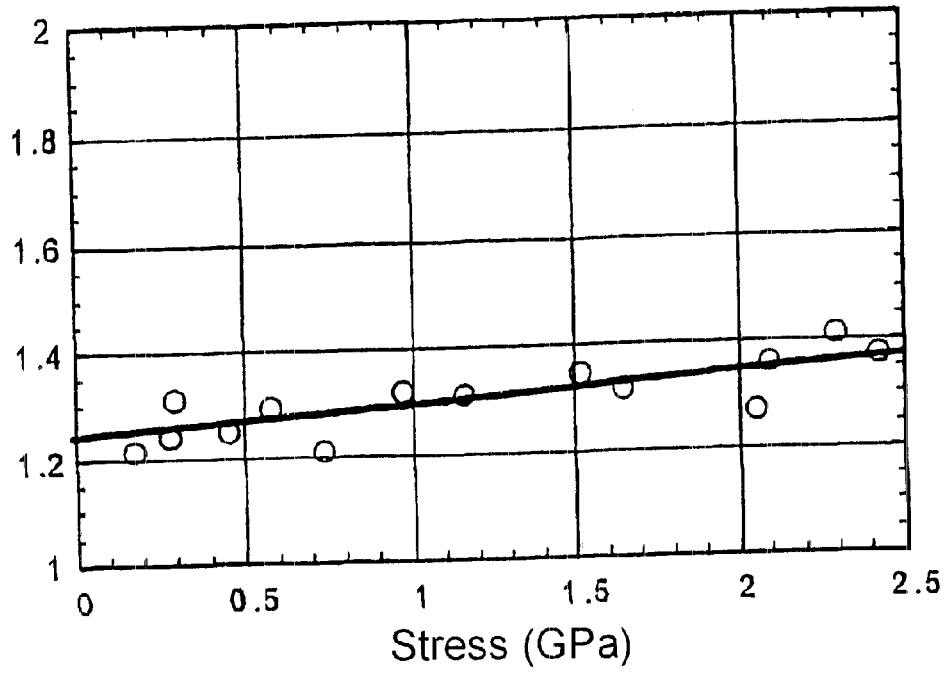
FIG. 5 shows the relationship between the half-height width and stress of a fiber relating to the present invention.

The diffraction intensity was recorded on an imaging plate available from Fuji Film Corp. (Fuji Film FDL UR-V). Reading of the diffraction intensity was carried out by means of digital microluminograph (PIX sys TEM) available from JEOL Ltd. In order to precisely evaluate the half-height width of a peak profile thus obtained, a combination of the Gaussian function and the Lorentzian function was utilized for curve fitting. Moreover, the results thus obtained were plotted against stresses applied to the fiber. The plotted data points lay in a linear line and the half-height width factor (Hws) was evaluated from the slope thereof. An evaluation example is given in FIG. 5.

Method for Measuring Orientation Change Factor

Figure 6:
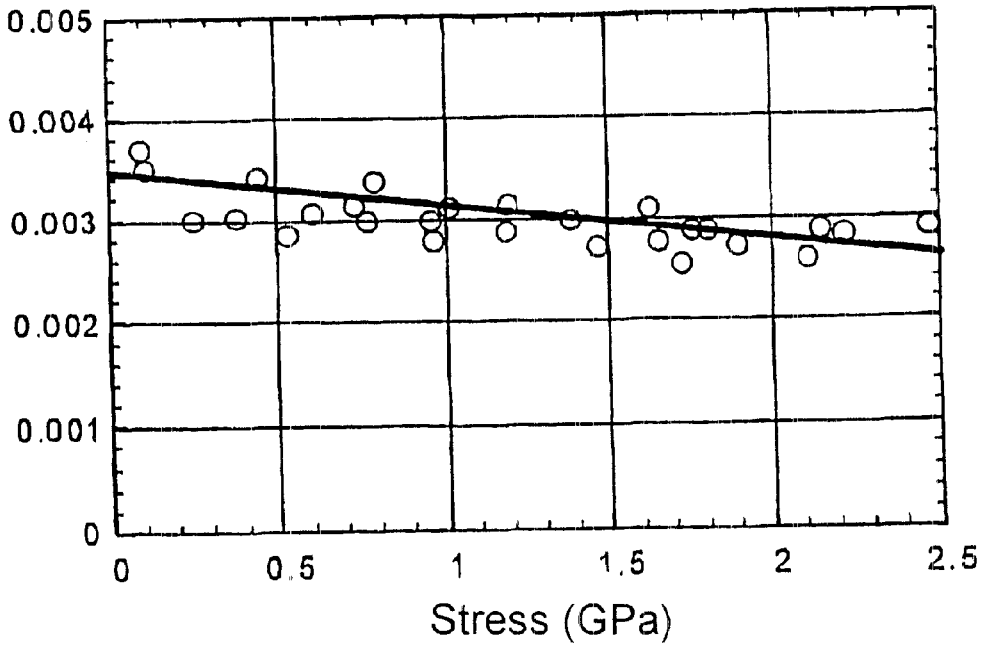
FIG. 6 shows the relationship between the $\langle \sin^2\Phi \rangle$ and stress of a fiber relating to the present invention.

The apparatus that applies stress to a fiber as previously discussed was installed on a small-angle X-ray scattering system available from Rigaku to measure the distribution diffraction intensity along the azimuthal direction of the (200) diffraction and to measure the elastic modulus $E_r$ attributed to the orientation change. FIG. 6 shows a measurement example of the orientation change ($<\sin^2\Phi>$).

The orientation change ($<\sin^2\Phi>$) was calculated from the azimuthal intensity profile $I(\Phi)$ of (200) diffraction using the following equation:

$$<\sin^2\phi> = \frac{\int_0^{\pi/2} I(\phi)\sin^3\phi d\phi}{\int_0^{\pi/2} I(\phi)\sin^3\phi d\phi}$$

The meridional line was taken as the origin of the azimuthal angle ($\Phi=0$). According to the theory proposed by Northolt (Polymer 21, p1199 (1980)), the strain ($\epsilon$) of the entire fiber can be expressed by the combination of the crystallite elongation ($\epsilon_c$) and the contribution of crystallite rotation ($\epsilon_r$)

$$\epsilon=\epsilon_c+\epsilon_r$$

$\epsilon_c$ can be expressed by the crystalline modulus $E_c$ and the stress $\sigma$,$\epsilon_r$ by utilizing the result (FIG. 6) obtained by determining the $<\sin^2\Phi>$as a function of $\sigma$ above, and thus $\epsilon$ can be rewritten in the following equation for calculation:

$$\epsilon=\sigma/E_c+(<\cos\Phi>/<\cos\Phi_0>-1)$$

wherein $\Phi_0$ is an orientation angle when the stress is zero, and $\Phi$ is an orientation angle when the stress is $\sigma$.

The amount of reduction of the elastic modulus $E_r$ attributed to the orientation change is defined by the following equation:

$$E_r = E_c - \left\langle \frac{d\varepsilon}{d\sigma}\bigg|_{\sigma=0} \right\rangle^{-1}$$

wherein the inside of the brackets of the right-side second term above is a slope of the tangent line of $\epsilon$ at $\sigma=0$.

Method for Measuring Solid-state NMR

The measurement of solid-state $^{13}C$ NMR was carried out using a Varian XL-300 spectrometer (300 MHz for 1H measurement, 75 MHz for $^{13}C$ measurement), the amplifiers A55-8801 and A55-6801MR available from THAMWAY Corp., and a probe available from DOTY Corp. The longitudinal relaxation times of the $^1H$ nucleus and $^{13}C$ nucleus were measured by CP-MAS. Measurements were performed under the conditions of room temperature, a sample rotational frequency of 4 KHz, a $^1H$ 90 degree pulse of 4.5 microseconds, a locking magnetic field strength of 55.5 KHz, a decoupler strength of 55.5 KHz, a contact time of 3 milliseconds, and a pulse holding time of 40 seconds. The $^1H$ nucleus longitudinal relaxation time ($T_{1H}$) was measured by the CP-MAS inversion recovery method, and the damping of the peak intensity I(t) associated with the retention time (t) of a peak appearing at 128 ppm was evaluated by curve fitting using the equation $I(t)=A\cdot\exp(-t/T_{1H})$. The $^{13}C$ nucleus longitudinal relaxation time ($T_{1C}$) was measured by Torchia method, with the retention times set at 0, 0.001, 1.56, 3.12, 6.24, 12.5, 25.0, 50.0, 100, 150, 200, 300, 400, 500, 600, 700, and 800 seconds. The damping of the peak intensity I(t) associated with the retention time (t) of a peak appearing at 128 ppm was evaluated by curve fitting using the equation $I(t)=A_o\cdot\exp(-t/0.1)+A_a\cdot\exp(-t/T_{1Ca})+A_b\cdot\exp(-t/T_{1Cb})+A_c\cdot\exp(-t/T_{1Cc})$. In this case, $T_{1Cc}$ ($T_{1Ca}\leqq T_{1Cb}\leqq T_{1Cc}$) is taken as the relaxation time $T_{1C}$ of the $^{13}C$ carbon nucleus.

Measurement of Thermal Conductivity

The measurement of thermal conductivity was performed at a temperature of 100 K in accordance with the method of Fujishiro et al. (Jpn. J. Appl. Vol. 36 (1997) p5633).

Evaluation of Anisotropy Factor of Expansion Coefficient

The anisotropy factor $\mu$ of the expansion coefficient is defined as the following equation:

$$\mu=(\Delta\epsilon/\Delta T)/(\Delta\epsilon_a/\Delta T)$$

wherein $(\Delta\epsilon/\Delta T)$ is the linear expansion coefficient of the fiber axis direction, $\epsilon_a$ is the strain of the lattice of the crystal in the axis direction, and $(\Delta\epsilon_a/\Delta T)$ is the expansion coefficient to the temperature change thereof.

The linear expansion coefficient was measured using a thermal mechanical analysis apparatus available from Mac Science Corp. The value was evaluated from the measured length of the sample fiber-in the fiber axis direction when the temperature was increased from 30° C. to 600° C. was observed and from the measured value of $(\Delta\epsilon/\Delta T)$ within the range of 100° C. to 400° C. $\epsilon$ represents the strain (value obtained by a measured fiber length at each temperature divided by a fiber length at 30° C. and then 1 being subtracted).

$(\Delta\epsilon_a/\Delta T)$ was evaluated by using the equation below and measuring the amount of change of the X-ray diffraction angle $2\theta_{200}$ of the (200) plane when the temperature was changed from 30° C. to 250° C.

$$\Delta\epsilon_a/\Delta T=-\cot\theta_{200}(\Delta\theta_{200}/\Delta T)$$

The diffraction angle can be precisely measured by means of the aforementioned imaging plate.

The velocity of sound was measured using a Leovibron DDV-5-B available from Toyo Boldwin. A total of 25 or more measurements was conducted by changing conditions in a sample length of 10 cm to 50 cm under a tension of 0 GPa to 1 GPa, and the value was evaluated by extrapolating to a sample length of 0 cm and to a tension of 0 GPa.

The present invention will be discussed in more detail by means of examples hereinafter; however, the invention is by no means limited to these examples.

EXAMPLES

Examples 1 to 9 and Comparison Examples 1 to 7

As yarn was used a yarn dope comprising 14.0% by weight of a polyparaphenylene benzobisoxazole which was obtained by the method disclosed in U.S. Pat. No. 4533693 and which has an intrinsic viscosity of 24.4 dL/g measured in a methanesulfonic acid solution at 30° C. and polyphosphoric acid containing 83.17% of diphosphorus pentaoxide. The dope was passed through a metal net-like filtering material and then was subjected to kneading by means of a two-axis kneading apparatus and degassing. The dope was spun out at 170° C. from a spinneret having 166 holes with the pressure increased and the polymer solution temperature kept at 170° C. The spun yarn was cooled using cooling air with a temperature of 60° C. and was further naturally cooled to 40° C. and then was introduced into a coagulating bath. A fiber was prepared by changing the coagulating solution and the temperature thereof. Thereafter, the fiber was wound around a gozzet roll and was given a constant speed to wash the yarn with ion-exchanged water in a second extracting bath. Then, the yarn was immersed in a 0.1 N sodium hydroxide solution and subjected to neutralization treatment. Also, it was washed in a water bath, wound up, placed in a drying oven at 80° C. for drying, and allowed to stand there until the water content of the fiber became 2.5%. Furthermore, the fiber was heat treated for 2.4 seconds under the conditions of a tension of 5.0 g/d and a temperature of 600° C. The results are given in Table 1.

TABLE 1

| | Coagulant | Coagulant temperature ° C. | Elastic modulus GPa | Crystallite orientation angle Degree | Crystallite orientation ratio % | Rms nm | Equilibrium moisture content % | Abrasion resistance Cycles | Void size Å. |
|---|---|---|---|---|---|---|---|---|---|
| Example 1 | 60% Phosphoric acid aqueous solution | 3 | 349 | 1.21 | 151 | 17.1 | 0.54 | 5411 | 50 |
| Example 2 | 60% Phosphoric acid aqueous solution | −10 | 352 | 1.09 | 152 | 16.2 | 0.55 | 5533 | 63 |
| Example 3 | 60% Phosphoric acid aqueous solution | −30 | 368 | 0.99 | 157 | 15.3 | 0.54 | 5674 | 79 |
| Example 4 | 40% Phosphoric acid aqueous solution | −10 | 336 | 1.33 | 133 | 19.1 | 0.59 | 5310 | 37 |
| Example 5 | 40% Phosphoric acid aqueous solution | −30 | 333 | 1.37 | 136 | 18.7 | 0.57 | 5321 | 41 |
| Example 6 | Ethanol | 3 | 381 | 0.77 | 141 | 14.2 | 0.51 | 5911 | 39 |
| Example 7 | Ethanol | −10 | 392 | 0.74 | 146 | 12.1 | 0.52 | 5982 | 41 |
| Example 8 | Ethylene glycol | 3 | 388 | 0.68 | 162 | 9.7 | 0.49 | 6021 | 92 |
| Example 9 | Ethylene glycol | −10 | 403 | 0.63 | 174 | 7.6 | 0.48 | 6744 | 89 |
| Comparison Example 1 | 20% Phosphoric acid aqueous solution | −30 | 286 | 1.42 | 121 | 22.9 | 0.71 | 4984 | 31 |
| Comparison Example 2 | 20% Phosphoric acid aqueous solution | −10 | 290 | 1.53 | 119 | 24.2 | 0.63 | 4963 | 33 |
| Comparison Example 3 | 40% Phosphoric acid aqueous solution | 3 | 281 | 1.61 | 117 | 23.1 | 0.65 | 4821 | 24 |
| Comparison Example 4 | 40% Phosphoric acid aqueous solution | 10 | 263 | 1.70 | 108 | 25.3 | 0.69 | 5001 | 23 |
| Comparison Example 5 | 60% Phosphoric acid aqueous solution | 10 | 310 | 1.89 | 111 | 27.1 | 0.62 | 5021 | 24 |
| Comparison Example 6 | Ethanol | 10 | 363 | 1.41 | 112 | 20.7 | 0.63 | 5110 | 39 |
| Comparison Example 7 | Ethylene glycol | 10 | 371 | 1.35 | 115 | 21.3 | 0.64 | 5029 | 63 |

Table 1 above shows that a fiber of the present invention has an extremely low equilibrium moisture content as compared with a conventional fiber and thus is truly excellent in physical properties. At the same time, the fiber is recognized to have a unique fine surface structure as well.

Examples 10 to 18 and Comparison Examples 8 to 13

As yarn was used a yarn dope comprising 14.0% by weight of a polyparaphenylene benzobisoxazole which was obtained by the method disclosed in U.S. Pat. No. 4533693 and which has an intrinsic viscosity of 24.4 dL/g measured in a methanesulfonic acid solution at 30° C. and polyphosphoric acid containing 83.17% of diphosphorus pentaoxide. The dope was passed through a metal net-like filtering material and then was subjected to kneading by means of a two-axis kneading apparatus and degassing. The dope was spun at 170° C. from a spinneret having 166 holes with the pressure increased and the polymer solution temperature kept at 170° C. The spun yarn was cooled using cooling air with a temperature of 60° C. and was further naturally cooled to 40° C. and then was introduced into a coagulating bath. A fiber was prepared by changing the coagulating solution and the temperature thereof. Thereafter, the fiber was wound around a gozzet roll and was given a constant speed to wash the yarn with ion-exchanged water in a second extracting bath. Then, the yarn was immersed in a 0.1 N sodium hydroxide solution and subjected to neutralization treatment. Also, it was washed in a water bath, wound up, placed in a drying oven at 80° C. for drying, and allowed to stand there until the water content of the fiber became 2.5%. Furthermore, the fiber was heat treated for 2.4 seconds under the conditions of a tension of 5.0 g/d and a temperature of 600° C. The results are given in Table 2.

TABLE 2

| | Coagulant | Temperature ° C. | Velocity of propagating sound $10^6$ cm/sec | Hws °/GPa | Er GPa | $T_{1H}$ sec | $T_{1C}$ sec | Thermal conductivity W/cm K | Expansion coefficient anisotropy factor 1/1000000 | Fiber elastic modulus GPa | Void size Å |
|---|---|---|---|---|---|---|---|---|---|---|---|
| Example 10 | 20% Phosphoric acid aqueous solution | −10 | 1.6 | 0.28 | 31 | 4.9 | 2120 | 0.25 | −4.7 | 290 | 33 |
| Example 11 | 40% Phosphoric acid aqueous solution | −30 | 1.9 | 0.21 | 28 | 5.3 | 2340 | 0.28 | −5.1 | 333 | 41 |
| Example 12 | 40% Phosphoric acid aqueous solution | −10 | 2.0 | 0.22 | 24 | 5.8 | 2420 | 0.29 | −5.7 | 336 | 37 |
| Example 13 | 40% Phosphoric acid aqueous solution | 3 | 1.7 | 0.26 | 33 | 4.7 | 2070 | 0.26 | −4.6 | 321 | 29 |
| Example 14 | 60% Phosphoric acid aqueous solution | 3 | 2.2 | 0.13 | 16 | 7.2 | 2670 | 0.3 | −7.3 | 349 | 50 |
| Example 15 | Ethanol | 3 | 2.1 | 0.19 | 21 | 6.1 | 2840 | 0.28 | −6.2 | 381 | 39 |
| Example 16 | Ethanol | −10 | 2.1 | 0.16 | 19 | 5.7 | 2930 | 0.34 | −6.9 | 392 | 41 |
| Example 17 | Ethylene glycol | 3 | 2.4 | 0.11 | 13 | 8.1 | 3210 | 0.36 | −8.9 | 388 | 92 |
| Example 18 | Ethylene glycol | −10 | 2.7 | 0.07 | 11 | 9.3 | 3280 | 0.37 | −10.2 | 403 | 89 |
| Comparison Example 8 | 20% Phosphoric acid aqueous solution | 3 | 1.2 | 0.45 | 33 | 4.7 | 1970 | 0.19 | −4.3 | 279 | 21 |
| Comparison Example 9 | 20% Phosphoric acid aqueous solution | 10 | 1.3 | 0.44 | 35 | 4.3 | 1830 | 0.18 | −4.1 | 281 | 22 |
| Comparison Example 10 | 40% Phosphoric acid aqueous solution | 10 | 1.2 | 0.38 | 39 | 3.9 | 1710 | 0.16 | −3.7 | 263 | 23 |
| Comparison Example 11 | 60% Phosphoric acid aqueous solution | 10 | 1.1 | 0.37 | 38 | 4.2 | 1820 | 0.17 | −4.2 | 310 | 24 |
| Comparison Example 12 | Ethanol | 10 | 1.2 | 0.32 | 34 | 4.3 | 1880 | 0.17 | −4.1 | 363 | 39 |
| Comparison Example 13 | Ethylene glycol | 10 | 1.3 | 0.35 | 37 | 4.5 | 1860 | 0.2 | −3.9 | 371 | 63 |

Table 2 above shows that a fiber of the present invention exhibits an extremely increased velocity of sound propagation as compared with a conventional fiber and thus is truly excellent in physical properties. At the same time, the fiber is recognized to have a fine structure with a very few defect structures as well.

Example 19

Two fibers of the fiber in Example 1 were combined to yield yarn of 555dtex. This combined yarn was woven in a weaving density of 30 fibers/inch to prepare a textile with a Metsuke of 136 g/m$^2$. Then, it was cut into a square of 40 cm and 33 sheets thereof were superimposed and integratedly sewed to prepare a bulletproof material. This bulletproof material was subjected to bullet hitting of 9 mm FMJ under the conditions of the NIJ Standard 0101.03, Level IIIA provision. As a result, the material prevented the penetration of a total of bullets.

Example 20

The fiber in Example 10 was divided into 60 pieces, each being set on a stand. The fiber was passed through a reed to become 16 fibers/cm and immersed in a bath of Cleiton G1650/toluene solution (solid content 20%). After being placed in a drying furnace for drying, the fiber was wound 11 turns around a roll with a circumference of 40 cm while taking care of not spacing to thereby produce a fiber sheet with the fiber neatly placed in one direction. The fiber sheet thus obtained was cut and spread to prepare a 40 cm×40 cm UD sheet. In a similar manner, a plurality of UD sheets was produced. An UD sheet thus obtained contained an average resin component of 15% by weight. Two of these UD sheets were superposed so as to be orthogonal to each other and the resulting sheet was covered on both sides with low molecular-weight polyethylene films with a thickness of 12 μm and then was compressed to prepare an orthogonal sheet. Metsuke for a sheet was 145 g/m$^2$. Twenty-six of these orthogonal sheets were superimposed and were sewn together to make a bulletproof material. This bulletproof material was subjected to bullet hitting of 9 mm FMJ under the conditions of the NIJ Standard 0101.03, Level IIIA provision. As a result, the material prevented the penetration of a total of bullets.

Example 21

The fiber in Example 1 was cut into 30 mm sheets and non-woven clothes with a Metsuke of 150 g/m$^2$ were prepared by the paper method. Four of the non-woven clothes thus obtained were superposed to prepare a marproof material.

Example 22

The fiber in Example 10 was crimped through the use of a crimper and then was cut into 44 mm sheets to give staple. The staple thus obtained was passed through a normal felt preparing step followed by a needle punch step to produce heat-resistant felt.

Industrial Applicability

The present invention, as discussed above, can industrially easily produce a polybenzazole fiber having a specific fine fiber structure of the fiber surface being dense, never obtained before, and thus enhances practicality as industrial material and has a very high degree of effectiveness of enlarging utilization fields.

In addition, the present invention as discussed above, can industrially easily produce a polybenzazole fiber having a specific fine fiber structure of the fiber structure being defect-free, never obtained before, and thus enhances practicality as industrial material and has a very high degree of effectiveness of enlarging utilization fields.

In other words, the present invention has a wide variety of applications that include, in addition to a high-density high-performance circuit board for mounting silicon chips, tension members such as cables, electric wires and optical fiber; tension materials such as ropes; aerial and aerospace materials such as rocket insulation, rocket casing, pressure vessels, strings for space suits and planet probe balloons; shock resistance materials such as bullet-proof materials (for example, a bullet-proof material made by laminating a fabric or a knitted web and a bullet-proof material made by alternately laminating in 90° directions multi-filament resin sheets that are neatly placed in one direction); mar-proof members such as gloves; heat-resistant flame-resistant members such as fire suits, heat resisting felt, gaskets for the plant, heat-resistant fabrics, various sealing materials, heat resisting cushions and filters; rubber-reinforcement materials for belts, tires, shoe soles, ropes, hoses, etc.; fishing lines, fishing rods, tennis rackets, ping-pong rackets, badminton rackets, golf shafts, club heads, gut, bowstrings, sail cloth; sports shoes such as running shoes, marathon shoes, spike shoes, skating shoes, basketball shoes and volleyball shoes; bicycles for competition (contest) and the wheels thereof, road racers, piste racers, mountain bicycles, composite wheels, disk wheels, tension disks, spokes, brake wires, transmission wires, wheel chairs for competition (contest) and the wheels thereof; sports relating materials for protectors, racing suits, skis, stocks, helmets, parachutes, etc.; abrasion-resistant materials for advanced belts, clutch fastenings, etc; reinforcing materials for various construction materials, rider suits, speaker cones, light-weight baby carriages, light-weight wheelchairs, light-weight beds for care, life saving boats, life jackets, and battery separators.

What is claimed is:

1. A polybenzazole fiber whose mean square roughness of the fiber surface is 20 nm or less.

2. A polybenzazole fiber according to claim 1, wherein the crystal orientation angle of the fiber surface is 1.3 degrees or less.

3. A polybenzazole fiber according to claim 1, wherein the equilibrium moisture content is 0.6% or less.

4. A polybenzazole fiber according to claim 1, wherein the number of cycles to the rupture in the abrasion test is 5,200 or more.

5. A polybenzazole fiber according to claim 1, wherein the fiber having voids with a void size of 25.5 Å or more.

6. A polybenzazole fiber whose the X-ray meridional diffraction half-height width factor is 0.3°/GPa or less.

7. A polybenzazole fiber according to claim 6, wherein the amount of reduction of the elastic modulus $E_r$ due to a molecular orientation change is 30 GPa or less.

8. A polybenzazole fiber according to claim 6, wherein the relaxation time $T_{1H}$ of proton is 5.0 seconds or more.

9. A polybenzazole fiber according to claim 6, wherein the relaxation time $T_{1C}$ of carbon 13 is 2,000 seconds or more.

10. A polybenzazole fiber according to claim 6, wherein the thermal conductivity is 0.23 W/cm K or more.

11. A polybenzazole fiber according to claim 6, wherein the anisotropy factor of the expansion coefficient is −4.5/1,000,000 or less.

12. A polybenzazole fiber according to claim 6, wherein the fiber elastic modulus is 300 GPa or more.

13. A polybenzazole fiber according to claim 6, wherein the fiber having voids with a void size of 25.5 Å or more.

14. A shock-resistant element which comprises the polybenzazole fiber according to claim 1 or 6.

15. Heat-resistant felt which comprises the polybenzazole fiber according to claim 1 or 6.

* * * * *

UNITED STATES PATENT AND TRADEMARK OFFICE

CERTIFICATE OF CORRECTION

PATENT NO. : 6,673,445 B2
DATED : January 6, 2004
INVENTOR(S) : Tooru Kitagawa et al.

It is certified that error appears in the above-identified patent and that said Letters Patent is hereby corrected as shown below:

Title page,
Item [87], PCT Pub. Date: change the PCT Publication Date: "August 11, 2001" to -- November 8, 2001 --

Signed and Sealed this

First Day of June, 2004

JON W. DUDAS
*Acting Director of the United States Patent and Trademark Office*